US010603948B2

(12) United States Patent
Odaka et al.

(10) Patent No.: US 10,603,948 B2
(45) Date of Patent: Mar. 31, 2020

(54) MECHANICAL PENCIL

(71) Applicant: KOTOBUKI & CO., LTD., Kawagoe-shi (JP)

(72) Inventors: Tadao Odaka, Kawagoe (JP); Yoshio Noguchi, Kawagoe (JP)

(73) Assignee: KOTOBUKI & CO., LTD., Kawagoe-Shi, Saitama (JP)

( * ) Notice: Subject to any disclaimer, the term of this patent is extended or adjusted under 35 U.S.C. 154(b) by 0 days.

(21) Appl. No.: 16/169,876

(22) Filed: Oct. 24, 2018

(65) Prior Publication Data

US 2019/0054756 A1 Feb. 21, 2019

Related U.S. Application Data

(63) Continuation of application No. PCT/JP2017/016650, filed on Apr. 27, 2017.

(30) Foreign Application Priority Data

Apr. 27, 2016 (JP) ..... 2016-088667

(51) Int. Cl.

| | |
|---|---|
| ***B43K 21/22*** | (2006.01) |
| ***B43K 21/20*** | (2006.01) |
| ***B43K 21/00*** | (2006.01) |
| ***B43K 21/16*** | (2006.01) |

(52) U.S. Cl.

CPC ..... *B43K 21/20* (2013.01); *B43K 21/00* (2013.01); *B43K 21/16* (2013.01); *B43K 21/22* (2013.01)

(58) Field of Classification Search

CPC ..... B43K 21/16; B43K 21/22

USPC ..... 401/92–94

See application file for complete search history.

(56) References Cited

U.S. PATENT DOCUMENTS

| | | | | |
|---|---|---|---|---|
| 4,106,874 A | | 8/1978 | Torii | |
| 4,386,865 A | * | 6/1983 | Kageyama ..... | B43K 21/22 401/54 |

FOREIGN PATENT DOCUMENTS

| | | |
|---|---|---|
| CN | 2558527 Y | 7/2003 |
| JP | S 50-138932 A | 11/1975 |
| JP | S 56-156689 U | 11/1981 |

(Continued)

OTHER PUBLICATIONS

International Search Report (ISR) (PCT Form PCT/ISA/210), in PCT/JP2017/016650, dated Jul. 18, 2017.

(Continued)

*Primary Examiner* — David J Walczak
*Assistant Examiner* — Joshua R Wiljanen
(74) *Attorney, Agent, or Firm* — McGinn IP Law Group, PLLC

(57) ABSTRACT

A mechanical pencil includes: a barrel; a cushion spring that has a rear end supported by the barrel; a sleeve that is biased forward in an axial direction by the cushion spring and movable in a direction perpendicular to the axial direction by an impact applied from outside of the barrel in an elastically supported state; a chuck spring that has a front end supported by the sleeve; a chuck that chucks a writing lead for a mechanical pencil; a writing lead tube that is fitted to the chuck and biased rearward in the axial direction together with the chuck by the chuck spring; and a contact sliding part that suppresses movement of the sleeve in the direction perpendicular to the axial direction.

8 Claims, 3 Drawing Sheets

(56) References Cited

FOREIGN PATENT DOCUMENTS

JP S 61-083980 U 6/1986

OTHER PUBLICATIONS

Chinese Office Action, dated Dec. 31, 2019, in Chinese Application No. 201780014399.0 and English Translation thereof.

* cited by examiner

MECHANICAL PENCIL

CROSS-REFERENCE TO RELATED APPLICATION

This application is based upon and claims the benefit of priority under 35 USC 119 of PCT Application No. PCT/JP2017/016650 filed on Apr. 27, 2017, the entire disclosure of which, including the description, claims, drawings, and abstract, is incorporated herein by reference in its entirety.

BACKGROUND

1. Technical Field

This disclosure relates to a mechanical pencil that includes a chuck for chucking a writing lead for a mechanical pencil and that is capable of feeding out the writing lead for a mechanical pencil by a push operation.

2. Related Art

Conventionally, a mechanical pencil is disclosed which is configured so that a chuck mechanism including a chuck and feeding out a writing lead for a mechanical pencil by a push operation is housed inside a sleeve with an approximately cylindrical shape and retained in a barrel. For example, in a mechanical pencil disclosed in Japanese Patent Application Laid-open No. S50-138932 (refer to, for instance, lines 1 to 8 in the lower right column on page 2 and lines 16 to 18 in the left column on page 3), a cushion spring is arranged to the rear of a sleeve. The sleeve is biased toward the front in the axial direction by the cushion spring. As a result, when excessive writing pressure is applied to a writing lead for a mechanical pencil during writing with the mechanical pencil, the sleeve moves rearward in the axial direction against a biasing force of the cushion spring. In this manner, breakage of the writing lead for a mechanical pencil during writing is prevented.

The mechanical pencil disclosed in Japanese Patent Application Laid-open No. S50-138932 is capable of preventing lead breakage of a writing lead for a mechanical pencil due to excessive writing pressure during writing. However, lead breakage may occur when an impact is applied to the mechanical pencil from the outside such as when the mechanical pencil is dropped. Therefore, there is a need to provide an impact-resistant mechanical pencil.

SUMMARY

This disclosure provides a mechanical pencil capable of preventing lead breakage of a writing lead for a mechanical pencil when an impact is applied to the mechanical pencil from the outside.

In an aspect of a mechanical pencil according to the present invention, the mechanical pencil includes a barrel; a cushion spring that is housed in the barrel and that has a rear end supported by the barrel; a sleeve that is housed in the barrel and that is biased forward in the axial direction with respect to the barrel by the cushion spring and movable in a direction perpendicular to the axial direction by an impact applied from outside of the barrel in a state of being elastically supported by the cushion spring; a chuck spring that is housed in the sleeve and that has a front end supported by the sleeve; a chuck that is housed in the barrel and chucks a writing lead for a mechanical pencil; a writing lead tube that houses the writing lead for a mechanical pencil housed in the barrel, and that is fitted to the chuck and biased rearward together with the chuck in the axial direction with respect to the sleeve by the chuck spring; and a contact sliding part that suppresses movement of the sleeve in a direction perpendicular to the axial direction.

According to an aspect of the present invention, a mechanical pencil capable of preventing lead breakage of a writing lead for a mechanical pencil when an impact is applied to the mechanical pencil from the outside can be provided.

EMBODIMENTS

Figure 1:
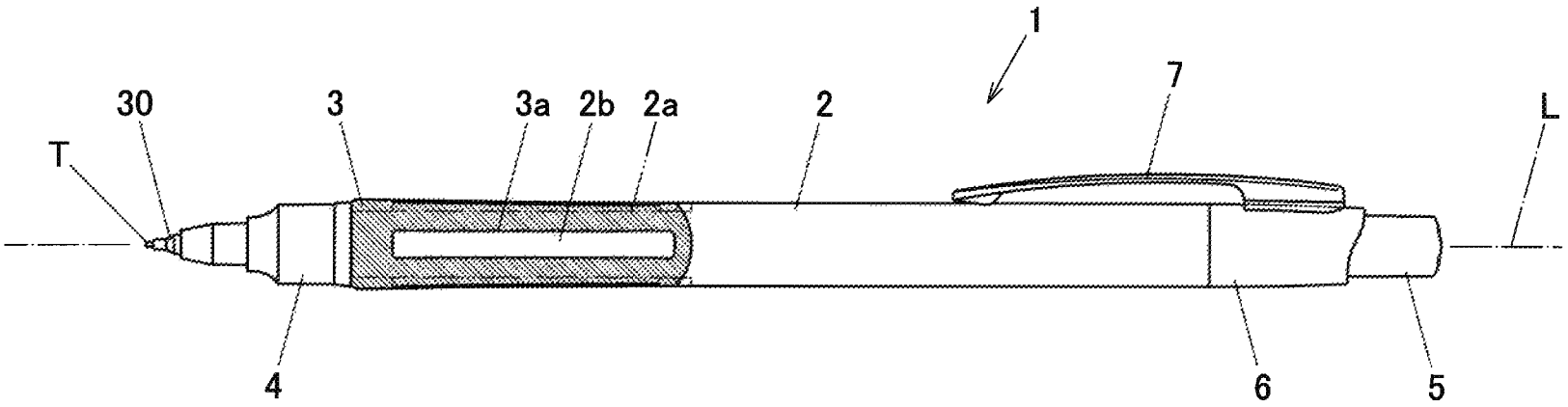
FIG. 1 is a front view illustrating an exterior of a mechanical pencil according to an embodiment of the present invention.

Hereinafter, an embodiment of the present invention will be described with reference to the drawings. FIG. 1 is a diagram illustrating an exterior of a mechanical pencil 1. The mechanical pencil 1 is a push-type mechanical pencil in which a writing lead T for a mechanical pencil is fed out by performing a push operation of a push button 5. The mechanical pencil 1 includes a barrel 2 formed in a cylindrical shape. A forward side of the barrel 2 is formed by double molding of a recessed part 2*a* and a protruding part 2*b* formed of a relatively hard primary molding material and a grip 3 formed of a relatively soft secondary molding material. The protruding part 2*b* formed of a relatively hard primary molding material is exposed from a hole part 3*a* having an approximately rectangular shape and extending in the front-rear direction (the axial direction) of the grip 3 formed of a relatively soft secondary molding material. A surface of the grip 3 and a surface of the protruding part 2*b* are substantially flush with each other. A tip fitting 4 is fixed to a front end of the barrel 2. A tip tube 30 having a tip opening from which protrudes the writing lead T for a mechanical pencil protrudes so as to be retractable from a front end of the tip fitting 4.

A top crown 6 is inserted and fixed to a rear end part of the barrel 2. The push button 5 is arranged at the rear end part of the top crown 6. By performing a push operation of the push button 5, the writing lead T for a mechanical pencil is fed out from the tip opening of the tip tube 30. A clip 7 is mounted to an outer circumferential surface of the top crown 6.

Figure 2:
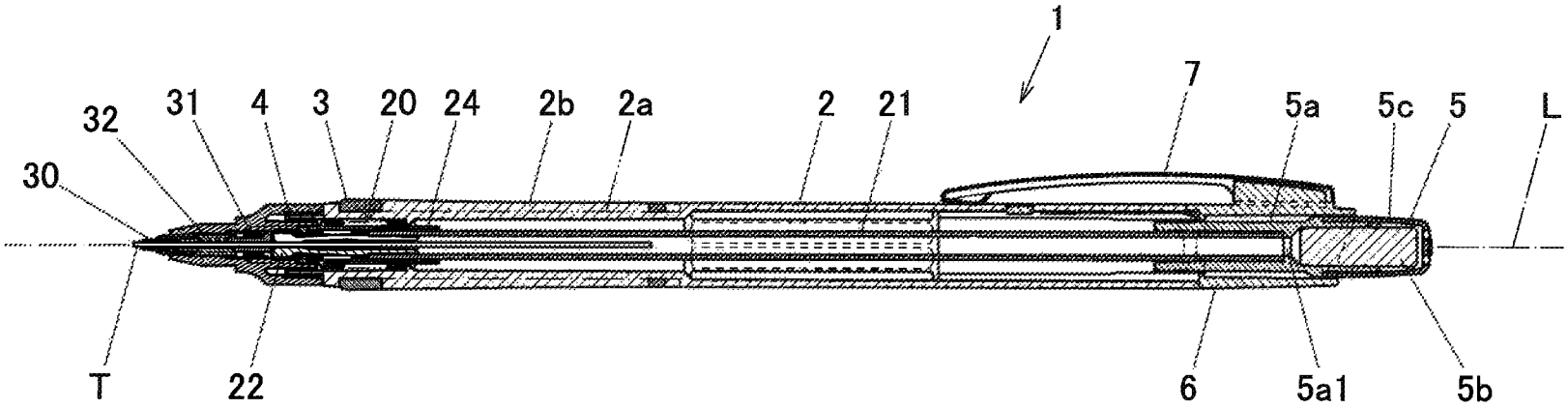
FIG. 2 is a longitudinal sectional view of a mechanical pencil according to an embodiment of the present invention.
Figure 3:
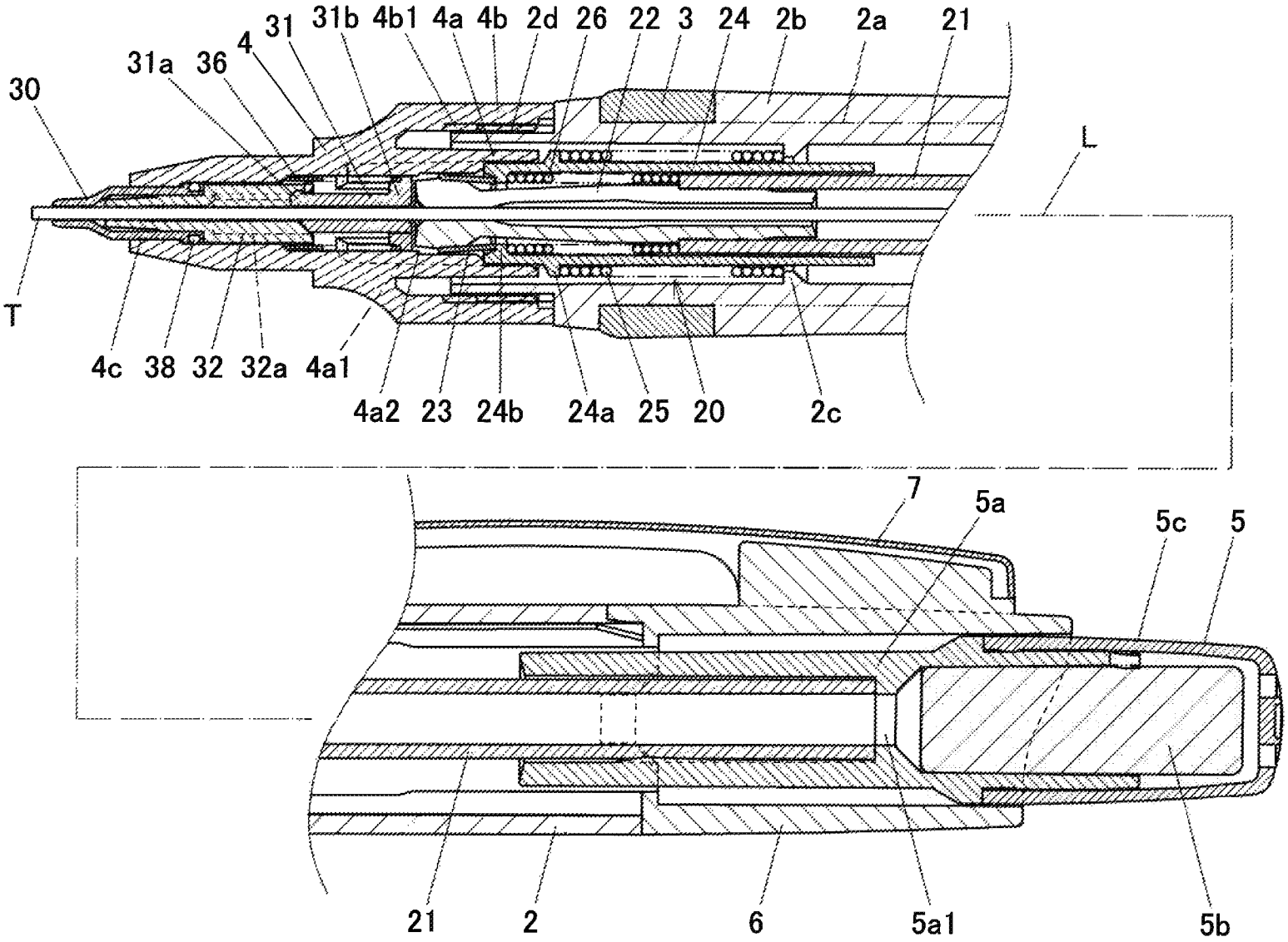
FIG. 3 is a partially-enlarged longitudinal sectional view illustrating, enlarged, a forward-side portion and a rearward-side portion while omitting an intermediate portion of a mechanical pencil according to an embodiment of the present invention.

FIG. 2 is a longitudinal sectional view illustrating the mechanical pencil 1 cut away along the longitudinal axial direction. FIG. 3 is a partially-enlarged longitudinal sectional view illustrating, enlarged, a forward-side portion and a rearward-side portion of the mechanical pencil 1 cut away along the longitudinal axial direction. A writing lead tube 21 extending forward and rearward is housed inside the barrel 2. The push button 5 is detachably mounted to the rear end of the writing lead tube 21. The push button 5 has a push button main body 5*a* that fits to an outer circumferential surface of the rear end of the writing lead tube 21, an eraser 5*b* held in the push button main body 5*a*, and a push cap 5*c* mounted to the push button main body 5*a* so as to cover the eraser 5*b*. When replenishing the writing lead T for a mechanical pencil to the writing lead tube 21, the push cap 5*c* and the eraser 5*b* are detached from the push button main body 5*a*. Subsequently, the writing lead T for a mechanical pencil is replenished into the writing lead tube 21 from the rear through a lead insertion hole 5*a*1 formed on the push button main body 5*a*. The push button 5 is movably guided along the axis L direction by the top crown 6 and mounted in a state where the push button 5 is restricted from moving in a direction perpendicular to the axis L direction.

The rear end of a chuck 22 is fitted and fixed to the front end of the writing lead tube 21. Three slits are formed on a tip of the chuck 22 at three locations in a circumferential direction thereof so that the writing lead T for a mechanical pencil can be chucked and released as each of three chuck pieces is elastically deformed and restored. A chuck ring 23 is detachably fitted to an outer circumference of a tip part of the chuck 22 from the rear. As will be described in detail later, a sleeve 24 with a cylindrical shape is assembled so as to be movable along the direction of the axis L and the direction perpendicular to the direction of the axis L to the chuck 22 and an outer circumference of a front end part of the writing lead tube 21 to the rear of the chuck ring 23.

As will be described in detail later, the sleeve 24 is configured so as to prevent an impact applied from the outside of the mechanical pencil 1 to be transmitted to the chuck 22 and the writing lead T for a mechanical pencil and, at the same time, prevent lead breakage of the writing lead T for a mechanical pencil by eliminating at least a part of energy of the impact with a contact sliding part. Therefore, the sleeve 24 is configured so as not to come into direct contact with the chuck 22 but, at the same time, for example, the sleeve 24 and the writing lead tube 21 are configured so as to come into contact with each other and slide when an impact is applied from the outside.

The mechanical pencil 1 and a chuck mechanism 20 according to the present embodiment will now be described in detail mainly with reference to FIG. 3. An inner circumferential surface of the sleeve 24 is configured so as to be separated as illustrated from an outer circumferential surface of the writing lead tube 21 so as to have a slight clearance and to be relatively movable in the direction of the axis L and the direction perpendicular to the direction of the axis L. When an impact is applied to the mechanical pencil 1 from the outside, an inner circumferential surface of a rear end part of the sleeve 24 comes into contact and slides with the outer circumferential surface of the writing lead tube 21. The sleeve 24 is movable in the direction perpendicular to the direction of the axis L and, at the same time, the movement of the sleeve 24 in the direction perpendicular to the direction of the axis L is suppressed by contact sliding (frictional sliding) due to a portion (a first contact sliding part) in which the writing lead tube 21 and the sleeve 24 come into contact and slide with each other.

The rear end part of the sleeve 24 abuts with the outer circumference of the writing lead tube 21 more strongly than with other portions. Therefore, in the present embodiment, the rear end of the sleeve 24 is formed protruding rearward so as to abut with the outer circumference of the writing lead tube 21 at a position further rearward in the direction of the axis L than the rear end of the chuck 22 fitted into the writing lead tube 21. Adopting such a configuration enables an impact applied to the mechanical pencil 1 from the outside to be prevented from being transmitted to the chuck 22 and enables the impact to be released to the writing lead tube 21. Since energy of the impact transmitted to the writing lead tube 21 is consumed (eliminated) by vibration or the like of an intermediate portion of the relatively-long writing lead tube 21 positioned between both supporting end parts of a front end in contact with the sleeve 24 and a rear end fitted to the push button 5 of the writing lead tube 21, the energy of the impact is unlikely to be transmitted to the chuck 22. The intermediate portion of the writing lead tube 21 eliminates an impact applied to the mechanical pencil 1 from the outside by, for example, vibrating in a vibration mode causing the intermediate portion to deform in a bow shape or the like.

An annular protruding part 24*b* is formed so as to protrude inward in a radial direction on an inner circumferential surface of the front end part of the sleeve 24. A rear surface of the chuck ring 23 abuts with a front surface of the protruding part 24*b*. A tip (the inner circumferential surface of the sleeve 24) of the protruding part 24*b* is sufficiently separated from the outer circumferential surface of the chuck 22 in the radial direction of the sleeve 24 so as not to come into contact with the outer circumferential surface of the chuck 22. A chuck spring 26 which is a compression coil spring to be compressed in the axial direction is arranged between a rear surface of the protruding part 24*b* and a front end surface of the writing lead tube 21 on the outer circumference of the chuck 22 inside the sleeve 24. A front end of the chuck spring 26 is supported in a state of abutting with a rear surface of the protruding part 24*b* of the sleeve 24. A rear end of the chuck spring 26 is supported in a state of abutting with the front end surface of the writing lead tube 21. The chuck spring 26 biases the writing lead tube 21, the chuck 22 fixed to the writing lead tube 21, and the chuck ring 23 fitted to and detached from the chuck 22 rearward in the direction of the axis L with respect to the sleeve 24. When the writing lead tube 21, the chuck 22, and the chuck ring 23 move rearward due to a biasing force of the chuck spring 26, the chuck ring 23 is fitted to the chuck 22 from the rear.

In the present embodiment, an outer circumference of the chuck spring 26 comes into contact with the inner circumferential surface of the sleeve 24 to constitute a part (a second contact sliding part) of the contact sliding part. When the sleeve 24 moves in the direction perpendicular to the direction of the axis L, the outer circumference of the chuck spring 26 and the inner circumferential surface of the sleeve 24 slide while being in contact with each other. By suppressing the movement of the sleeve 24 in the direction perpendicular to the direction of the axis L by contact sliding (frictional sliding) with the second contact sliding part, at least a part of energy of an impact applied to the mechanical pencil 1 from the outside can be eliminated. Therefore, lead breakage of the writing lead T for a mechanical pencil can be prevented.

An annular protruding part 24*a* is formed so as to protrude outward in the radial direction on an outer circumferential surface of a front part of the sleeve 24. An annular protruding part 2*c* is formed so as to protrude inward in the radial direction on an inner circumferential surface of the barrel 2 so as to oppose the protruding part 24*a* of the sleeve in the axial direction. A cushion spring 25 which is a compression coil spring to be compressed in the direction of the axis L is arranged between the protruding part 24*a* of the sleeve and the protruding part 2*c* of the barrel. In the cushion spring 25, a front end in the direction of the axis L thereof is supported in a state of abutting with the protruding part 24*a* of the sleeve and a rear end thereof is supported in a state of abutting with the protruding part 2*c* of the barrel. In this manner, the cushion spring 25 is arranged extending in the direction of the axis L between the sleeve 24 and the barrel 2. The sleeve 24 is biased forward by the cushion spring 25.

A tip protruding inward in the radial direction (in other words, an inner circumferential end) of the protruding part 2*c* of the barrel 2 and the outer circumferential surface of the sleeve 24 are configured so as to be separated from each other so as to have a prescribed clearance (predetermined clearance) in the radial direction. In addition, a tip protruding outward in the radial direction (in other words, an outer circumferential end) of the protruding part 24*a* of the sleeve 24 and the inner circumferential surface of the barrel 2 are configured so as to be separated from each other so as to have a prescribed clearance in the radial direction. Furthermore, an outer circumference of the cushion spring 25 and the inner circumferential surface of the barrel 2 are configured so as to be separated from each other so as to have a prescribed clearance in the radial direction. Therefore, when the sleeve 24 housed in the barrel 2 is subjected to an impact from the outside of the barrel 2 in a state of being biased toward the front in the direction of the axis L and being elastically supported by the cushion spring 25, the sleeve 24 is movable by a prescribed amount of movement (a travel distance) in the direction perpendicular to the direction of the axis L. In the present embodiment, since a configuration is adopted in which the sleeve 24 is elastically supported by the cushion spring 25 with respect to the barrel 2, at least a part of energy of an impact applied from the outside of the barrel 2 can be absorbed by the elasticity of the cushion spring 25.

In addition, in the present embodiment, since the rear end of the sleeve 24 is arranged so as to protrude to a position further rearward in the direction of the axis L than the protruding part 2*c* of the barrel 2 as described earlier, a clearance in the radial direction between the tip of the protruding part 2*c* of the barrel 2 and the outer circumferential surface of the sleeve 24 can be preferably configured as a prescribed interval. As will be described in detail later, as long as an occurrence of lead breakage of the writing lead T for a mechanical pencil at a position on the front end surface of the chuck 22 can be prevented, in order to eliminate an impact applied from the outside of the mechanical pencil 1, it is preferable to allow significant movement of the sleeve 24 in the direction perpendicular to the direction of the axis L with the prescribed clearance with the largest amount of movement (a travel distance) as possible. For example, the prescribed clearance in the radial direction between the tip of the protruding part 2*c* of the barrel and the outer circumferential surface of the sleeve 24 may be favorably configured as a clearance equal to or larger than 10% of a wire diameter of the cushion spring 25, more favorably configured as a clearance equal to or larger than 30% of the wire diameter of the cushion spring 25, and most favorably configured as a clearance equal to or larger than 50% of the wire diameter of the cushion spring 25.

An inner circumference of the cushion spring 25 according to the present embodiment comes into contact with the outer circumferential surface of the sleeve 24 to constitute another part (a third contact sliding part) of the contact sliding part. By suppressing the movement of the sleeve 24 in the direction perpendicular to the direction of the axis L by contact sliding (frictional sliding) with the third contact sliding part, at least a part of energy of an impact applied to the mechanical pencil 1 from the outside can be eliminated. Therefore, lead breakage of the writing lead T for a mechanical pencil can be prevented. The writing lead T for a mechanical pencil of the mechanical pencil is a brittle material (fragile material) susceptible to lead breakage. Therefore, a configuration which suppresses a movement of the sleeve 24 by a prescribed allowed amount of movement in the direction perpendicular to the direction of the axis L by contact sliding as in the case of the mechanical pencil 1 according to the present embodiment is important for preventing lead breakage of the writing lead T for a mechanical pencil.

The rear part of the tip fitting 4 is formed in a double cylindrical shape having an inner cylinder 4*a*. An outer circumferential surface of the inner cylinder 4*a* and the inner circumferential surface of the barrel 2 are sufficiently separated so as not to come into direct contact with each other. A configuration is adopted in which a prescribed clearance is provided between an inner circumferential surface of the inner cylinder 4*a* and the outer circumferential surface of the sleeve 24 and the sleeve 24 can move in the direction perpendicular to the direction of the axis L when an impact is applied from the outside of the mechanical pencil 1 (the barrel 2). A possibility of lead breakage of the writing lead T for a mechanical pencil of the mechanical pencil 1 is highest at the tip part (a position in a vicinity of a tip surface) of the chuck 22 chucking the writing lead T for a mechanical pencil. Therefore, in order to prevent lead breakage of the writing lead T for a mechanical pencil when the sleeve 24 moves in the direction perpendicular to the direction of the axis L, an allowable amount of movement of the sleeve 24 is favorably configured so as to become a smaller amount of movement as the sleeve 24 approaches the tip part of the chuck 22. In other words, the prescribed clearance is favorably configured so as to increase proportionally with the distance from the tip part of the chuck 22 in the direction of the axis L. Therefore, the prescribed clearance between the inner circumferential surface of the inner cylinder 4*a* of the tip fitting and the outer circumferential surface of the sleeve 24 is configured so as to be smaller as compared to the prescribed clearance between the barrel 2 and the sleeve 24 described earlier. Adopting a configuration so as to allow movement of the sleeve 24 in the direction perpendicular to the direction of the axis L enables lead breakage of the writing lead T for a mechanical pencil to be prevented more effectively.

Ribs 4*a*1 extending in the direction of the axis L are formed in the circumferential direction on the inner circumferential surface of the inner cylinder 4*a* of the tip fitting 4. The front end surface of the sleeve 24 abuts with the rear end surfaces of the ribs 4*a*1 in a state of being biased forward by the cushion spring 25. The front end surface of the sleeve 24 and the rear end surfaces of the ribs 4*a*1 come into contact with each other and constitute yet another part (a fourth contact sliding part) of the contact sliding part. By suppressing the movement of the sleeve 24 in the direction perpendicular to the direction of the axis L by contact sliding (frictional sliding) with the fourth contact sliding part, at least a part of energy of an impact applied to the mechanical pencil 1 from the outside can be eliminated. Therefore, lead breakage of the writing lead T for a mechanical pencil can be prevented. As described above, in the present embodiment, "suppressing" refers to an effect of imparting a load (a resistance) with respect to a movement of the sleeve 24 while allowing the movement of the sleeve 24.

Step parts 4*a*2 that can be abutted with when a front end surface of the chuck ring 23 moves forward are formed at a central position in the direction of the axis L of the ribs 4*a*1. When the front end surface of the chuck ring 23 abuts with the step parts 4*a*2 of the ribs 4*a*1 formed on the inner cylinder of the tip fitting 4, the chuck ring 23 disengages rearward from the chuck 22 and the writing lead T for a mechanical pencil is released from chucking by the chuck 22. A series of feed-out actuations by the mechanical pencil 1 will be described in detail later.

An internal screw part 4*b*1 is formed on an inner circumferential surface of an outer cylinder 4*b* formed in a double cylindrical shape of the rear end part of the tip fitting 4. In addition, an external screw part 2*d* corresponding to the internal screw part 4*b*1 of the tip fitting 4 is formed on an outer circumferential surface of the tip part of the barrel 2. The internal screw part 4*b*1 and the external screw part 2*d* screw together to fix the tip fitting 4 to the barrel 2.

A guide tube 31 is arranged so as to be movable in the direction of the axis L at a position to the front in the vicinity of the front end surface of the chuck 22. The guide tube 31 has a disk-shaped base end part 31*b*, a central hole into which the writing lead T for a mechanical pencil is inserted in the direction of the axis L, and insertion legs 31*a* formed around the central hole so as to protrude forward from the base end part 31*b*. The tips of the insertion legs 31*a* are formed in hook shapes as illustrated and, when engaged inside slits 32*a* formed in a lead holder 32 to be described in detail later, the insertion legs 31*a* are locked so as to be relatively movable in a front-rear direction with respect to the lead holder 32.

A step part is formed on an outer circumferential edge of the base end part 31*b* of the guide tube 31. In addition, a step part of an inner circumference of the tip fitting 4 is formed on an inner circumferential surface of the tip fitting 4 that opposes the step part of the base end part 31*b* of the guide tube 31 in the direction of the axis L. A return spring 36 that is a compression coil spring for biasing the guide tube 31 rearward in the direction of the axis L with respect to the tip fitting 4 is arranged between the base end part 31*b* of the guide tube 31 and the step part of the inner circumference of the tip fitting 4. In a state where the guide tube 31 is biased rearward by the return spring 36, the rear end surface of the base end part 31*b* of the guide tube 31 approaches the front end surface of the chuck 22 from the front. In addition, when the chuck 22 moves forward, the rear end surface of the guide tube 31 abuts with the tip surface of the chuck 22 from the front. In a state where the rear end surface of the guide tube 31 approaches or abuts with the tip surface of the chuck 22 from the front, the rear end surface of the guide tube 31 supports, in the direction perpendicular to the direction of the axis L, the writing lead T for a mechanical pencil protruding from the tip surface of the chuck 22. Therefore, a bending moment acting on a position on the tip surface of the chuck 22 in the direction of the axis L of the writing lead T for a mechanical pencil chucked by the chuck 22 can be reduced and an occurrence of lead breakage of the writing lead T for a mechanical pencil at the position on the tip surface of the chuck 22 can be prevented.

The lead holder 32 is arranged so as to be movable in the direction of the axis L at a position to the front of the guide tube 31. Slits 32*a* extending in the front-rear direction are formed on the lead holder 32. The tips formed in hook shapes of the insertion legs 31*a* of the guide tube 31 described earlier is engaged so as to be slidable inside the slits 32*a*. Accordingly, the guide tube 31 is locked so as to be relatively movable in the front-rear direction with respect to the lead holder 32. A central hole into which the writing lead T for a mechanical pencil is inserted in the direction of the axis L is formed in the lead holder 32. A holding part that clamps and holds the writing lead T for a mechanical pencil inward in the radial direction is formed at the tip portion of the central hole of the lead holder 32. The lead holder 32 is inserted into the tip tube 30 described earlier from the rear and assembled to the tip tube 30.

A flange part is formed at the rear end of the tip tube 30. An O ring 38 that elastically supports the tip tube 30 and the lead holder 32 in the direction perpendicular to the direction of the axis L is assembled to an outer circumference of the flange part. The O ring 38 is configured so as to impart an appropriate sliding resistance with respect to movements of the tip tube 30 and the lead holder 32 in the front-rear direction. In this case, the appropriate sliding resistance refers to a sliding resistance capable of holding the tip tube 30 and the lead holder 32 so that the writing lead T for a mechanical pencil having been fed out can be held in its position in the direction of the axis L. In addition, the appropriate sliding resistance refers to a sliding resistance which, when a larger pressing force in the direction of the axis L is applied to the tip tube 30 and the lead holder 32, allows movements of the tip tube 30 and the lead holder 32 so that the tip tube 30 protrudes from the tip fitting 4 or the tip tube 30 is retracted into the tip fitting 4. An outer circumference of the O ring 38 is pressed in a state of being elastically deformed on an inner circumferential surface of an opening part 4*c* of the tip fitting 4. By elastically supporting the tip tube 30 and the lead holder 32 with the O ring 38, a part of an impact applied from outside of the mechanical pencil 1 can be absorbed by the O ring 38. Forward movements of the tip tube 30 and the lead holder 32 are restricted as the flange part of the tip tube 30 abuts with a step part formed on the inner circumferential surface of the opening part 4*c* of the tip fitting.

A series of feed-out actuations by the mechanical pencil 1 will now be described. When the push button 5 at the rear end of the mechanical pencil 1 is pressed, the writing lead tube 21 moves forward against the biasing force of the chuck spring 26. As described earlier, the chuck 22 is fixed to the tip part of the writing lead tube 21. In a state where the chuck ring 23 is fitted to the chuck 22, since the chuck 22 is pressed inward in the radial direction by the chuck ring 23, the writing lead T for a mechanical pencil is chucked by the chuck 22. Therefore, the chuck 22, the chuck ring 23, and the writing lead T for a mechanical pencil move forward together with the writing lead tube 21. The guide tube 31 abutting with the chuck 22 having moved forward is also pressed toward the front and moves forward against a biasing force of the return spring 36. When the guide tube 31 moves forward, the lead holder 32 and the tip tube 30 pressed by the guide tube 31 move forward and protrude from the tip fitting 4.

When the front end surface of the chuck ring 23 moves forward and abuts with the step parts 4*a*2 of the tip fitting 4, the chuck ring 23 disengages rearward from the chuck 22. Once the chuck ring 23 disengages, since the chuck 22 is resiliently restored and opens due to its elasticity, the writing lead T for a mechanical pencil is released from chucking by the chuck 22. The writing lead T for a mechanical pencil is held by the lead holder 32 at a position where the writing lead T for a mechanical pencil has been released from chucking by the chuck 22. Subsequently, when the push button 5 of the mechanical pencil 1 is released from being pressed, the writing lead tube 21, the chuck 22, and the chuck ring 23 recede due to the biasing force of the chuck spring 26 while the tip tube 30, the lead holder 32, and the writing lead T for a mechanical pencil remain as is. The guide tube 31 recedes due to the biasing force of the return spring 36. When the chuck ring 23 is once again fitted to the outer circumference of the chuck 22 due to the receding, the chuck 22 once again clamps and chucks the writing lead T for a mechanical pencil at a position further rearward than before. In this manner, the writing lead T for a mechanical pencil is fed out from the mechanical pencil 1 and protrudes from the tip tube 30 to create a state illustrated in FIGS. 2 and 3.

When writing pressure that is stronger than required for ordinary writing is applied to the writing lead T for a mechanical pencil when writing with the mechanical pencil 1, the cushion spring 25 is compressed and the sleeve 24, the chuck spring 26, the writing lead tube 21, the chuck 22, the chuck ring 23, the writing lead T for a mechanical pencil, and the push button 5 recede rearward along the direction of the axis L with respect to the barrel 2. Therefore, the mechanical pencil 1 according to the present embodiment can absorb excess writing pressure and prevent lead breakage. In addition, as described earlier, the mechanical pencil 1 according to the present embodiment is configured so as to be capable of preventing lead breakage by supporting the writing lead T for a mechanical pencil at the front of the front end surface of the chuck 22 in the direction perpendicular to the direction of the axis L with the guide tube 31, the lead holder 32, and the tip tube 30.

Furthermore, as described earlier, the mechanical pencil 1 according to the present embodiment can also protect the writing lead T for a mechanical pencil so that the writing lead T for a mechanical pencil is less likely to break with respect to an impact from the outside of the mechanical pencil 1 such as when the mechanical pencil 1 is dropped. When the mechanical pencil 1 receives an impact from the outside such as when the mechanical pencil 1 is dropped, the sleeve 24 moves in the direction perpendicular to the direction of the axis L. At this point, an amount of movement by which the sleeve 24 is movable in the direction perpendicular to the direction of the axis L is a prescribed amount (predetermined amount) of movement allowed by a prescribed clearance (predetermined clearance) to ensure that lead breakage of the writing lead T for a mechanical pencil does not occur. In the present embodiment, as described earlier, the prescribed clearance is set so as to increase in proportion to an amount of separation in the direction of the axis L from the tip surface of the chuck 22. Therefore, the amount of movement of the sleeve 24 in the direction perpendicular to the direction of the axis L is allowed so that an amount of movement of the rear end part of the sleeve 24 in the direction perpendicular to the direction of the axis L is larger than an amount of movement of the front end part of the sleeve 24 in the direction perpendicular to the direction of the axis L.

In this manner, in order to allow movement in the direction perpendicular to the direction of the axis L, an arrangement position of the protruding part 24*a* of the sleeve 24 being elastically supported by the cushion spring 25 is favorably arranged in a portion to the front of the sleeve 24 in the direction of the axis L. For example, the protruding part 24*a* of the sleeve 24 may be favorably arranged in a front half portion of the sleeve 24, and the protruding part 24*a* of the sleeve 24 may be more favorably arranged at a position of which a distance from the front end of the sleeve 24 is equal to or less than 40% of an entire length of the sleeve 24 in the direction of the axis L, and the protruding part 24*a* of the sleeve 24 may be most favorably arranged at a position of which a distance from the front end of the sleeve 24 is equal to or less than 30% of the entire length of the sleeve 24 in the direction of the axis L. Adopting this configuration enables movement to be allowed so that the rear end part of the sleeve 24 moves by a larger amount than the front end part of the sleeve 24 in the direction perpendicular to the direction of the axis L with a position where the protruding part 24*a* of the sleeve 24 is arranged as a center of rotation in a pitching/yawing direction of the sleeve 24. As shown in the present embodiment, the rear end part of the sleeve 24 is favorably configured as a free end that is not supported by the cushion spring 25 or the like. By adopting this configuration, the rear end part of the sleeve 24 can be configured so as to be freely movable in the direction perpendicular to the direction of the axis L.

As described earlier, a movement of the sleeve 24 in the direction perpendicular to the direction of the axis L which occurs within an allowed range of the amount of movement is suppressed by contact sliding (frictional sliding) by the contact sliding part (the first to fourth contact sliding parts). In this case, at least a part of energy of an impact transmitted from the outside of the mechanical pencil 1 (the barrel 2) to the chuck 22 (the writing lead T for a mechanical pencil) can be preferably consumed and eliminated by contact sliding (frictional sliding) by the contact sliding part. In particular, an impact applied in the direction perpendicular to the direction of the axis L from the outside of the mechanical pencil 1 can be preferably eliminated. Therefore, lead breakage of the writing lead T for a mechanical pencil can be prevented. Moreover, in another embodiment, a configuration may be adopted in which a coefficient of friction in the contact sliding part is set higher than other portions of a mechanical pencil in order to improve efficiency of elimination (reduction) of the energy of an impact by contact sliding (frictional sliding) by the contact sliding part. Alternatively, in order to further increase contact pressure in the contact sliding part as compared to the contact pressure described in the present embodiment, dimensions and shapes of components constituting the contact sliding part or pressing forces applied by the respective springs may be modified. In this case, an impact applied to the mechanical pencil from the outside can be eliminated more efficiently.

A concept of "movement" of the sleeve within an allowed range of the amount of movement (movement distance) which occurs when an impact from the outside is received as described earlier includes a concept of "vibration" of the sleeve within an allowed amplitude range which occurs when the elastically-supported sleeve receives an impact from the outside. In addition, when "movement" includes "vibration", a concept of "suppression" by the contact sliding part includes a concept of "vibration attenuation (damping)" by the contact sliding part.

While embodiments of the present invention have been described above, it is to be understood that the present invention is not limited to the embodiments described above and may be implemented with a wide variety of modifications. For example, a configuration may be adopted in which the contact sliding part is constituted by any one of or a combination of any two or more of the first to fourth contact sliding parts. In addition, the contact sliding part is not limited to the embodiments of the first to fourth contact sliding parts, and may be configured in any way in which the movement of the sleeve in the direction perpendicular to the axial direction is suppressed. The contact sliding part may be arranged along an arbitrary extending direction and, for example, a contact sliding part extending in a direction having an arbitrary angle with respect to the axial direction of a mechanical pencil may be arranged so as come into contact and slide with a sleeve and suppress movement of the sleeve in the direction perpendicular to the axial direction.

What is claimed is:

1. A mechanical pencil, comprising:

a barrel;

a cushion spring that is housed in the barrel and that has a rear end being supported by the barrel;

a sleeve that is housed in the barrel and that is biased forward in an axial direction with respect to the barrel by the cushion spring and movable in a direction perpendicular to the axial direction by an impact applied from outside of the barrel in a state of being elastically supported by the cushion spring;

a chuck spring that is housed in the sleeve and that has a front end supported by the sleeve;

a chuck that is housed in the barrel and chucks a writing lead for a mechanical pencil;

a writing lead tube that houses the writing lead for a mechanical pencil housed in the barrel, and that is fitted to the chuck and biased rearward together with the chuck in the axial direction with respect to the sleeve by the chuck spring; and a contact sliding part that suppresses movement of the sleeve in the direction perpendicular to the axial direction, wherein the sleeve includes a protruding part that protrudes outward in a radial direction from an outer circumferential surface of the sleeve, the barrel includes a protruding part that protrudes inward in a radial direction from an inner circumferential surface of the barrel, the cushion spring is arranged between the protruding part of the sleeve and the protruding part of the barrel in the axial direction, and a tip of the protruding part of the sleeve and the inner circumferential surface of the barrel, as well as a tip of the protruding part of the barrel and the outer circumferential surface of the sleeve are respectively separated from each other so as to have a prescribed clearance in the radial direction.

2. The mechanical pencil according to claim 1, wherein a rear end of the sleeve protrudes further rearward in the axial direction than a rear end of the chuck, and when the sleeve moves in a direction perpendicular to the axial direction due to an impact applied from an outside of the barrel, an inner circumference of the rear end of the sleeve and an outer circumference of the writing lead tube come into contact with each other thereby constituting the contact sliding part.

3. The mechanical pencil according to claim 2, wherein an outer circumference of the chuck spring comes into contact with an inner circumferential surface of the sleeve thereby constituting one of the contact sliding parts, an inner circumference of the cushion spring comes into contact with an outer circumferential surface of the sleeve thereby constituting another of the contact sliding parts, and an outer circumference of the cushion spring and the inner circumferential surface of the barrel are separated from each other with a prescribed clearance in the radial direction.

4. The mechanical pencil according to claim 1, wherein an outer circumference of the chuck spring comes into contact with an inner circumferential surface of the sleeve thereby constituting one of the contact sliding parts, an inner circumference of the cushion spring comes into contact with an outer circumferential surface of the sleeve thereby constituting another of the contact sliding parts, and an outer circumference of the cushion spring and the inner circumferential surface of the barrel are separated from each other with a prescribed clearance in the radial direction.

5. A mechanical pencil, comprising:

a barrel;

a cushion spring that is housed in the barrel and that has a rear end being supported by the barrel;

a sleeve that is housed in the barrel and that is biased forward in an axial direction with respect to the barrel by the cushion spring and movable in a direction perpendicular to the axial direction by an impact applied from outside of the barrel in a state of being elastically supported y the cushion spring;

a chuck spring that is housed in the sleeve and that has a front end supported by the sleeve;

a chuck that is housed in the barrel and chucks a writing lead for a mechanical pencil;

a writing lead tube that houses the writing lead for a mechanical pencil housed in the barrel, and that is fitted to the chuck and biased rearward together with the chuck in the axial direction with respect to the sleeve by the chuck spring; and a contact sliding part that suppresses movement of the sleeve in the direction perpendicular to the axial direction, wherein an outer circumference of the chuck spring comes into contact with an inner circumferential surface of the sleeve thereby constituting one of the contact sliding parts, an inner circumference of the cushion spring comes into contact with an outer circumferential surface of the sleeve thereby constituting another of the contact sliding parts, and an outer circumference of the cushion spring and the inner circumferential surface of the barrel separated from each other with a prescribed clearance in the radial direction.

6. The mechanical pencil according to claim 5, wherein a rear end of the sleeve protrudes further rearward in the axial direction than a rear end of the chuck, and when the sleeve moves in a direction perpendicular to the axial direction due to an impact applies from an outside of the barrel, an inner circumference of the rear end of the sleeve and an outer circumference of the writing lead tube come into contact with each other thereby constituting the contact sliding part.

7. The mechanical pencil according to claim 6, further comprising a plurality of the contact sliding parts, wherein an outer circumference of the chuck spring comes into contact with an inner circumferential surface of the sleeve thereby constituting one of the contact sliding parts, an inner circumference of the cushion spring comes into contact with an outer circumferential surface of the sleeve thereby constituting another of the contact sliding parts, and an outer circumference of the cushion spring and the inner circumferential surface of the barrel are separated from each other with a prescribed clearance in the radial direction.

8. The mechanical pencil according to claim 5, further comprising a plurality of the contact sliding parts, wherein an outer circumference of the chuck spring comes into contact with an inner circumferential surface of the sleeve thereby constituting one of the contact sliding parts, an inner circumference of the cushion spring comes into contact with an outer circumferential surface of the sleeve thereby constituting another of the contact sliding parts, and an outer circumference of the cushion spring and the inner circumferential surface of the barrel are separated from each other with a prescribed clearance in the radial direction.

* * * * *